US012270145B2

(12) United States Patent
Dunn et al.

(10) Patent No.: US 12,270,145 B2
(45) Date of Patent: Apr. 8, 2025

(54) DRYER APPLIANCE AND METHOD FOR OPERATION

(71) Applicant: Haier US Appliance Solutions, Inc., Wilmington, DE (US)

(72) Inventors: David Scott Dunn, Louisville, KY (US); Jivko Ognianov Djerekarov, Louisville, KY (US); Daniele Martinello, Nuremberg (DE)

(73) Assignee: Haier US Appliance Solutions, Inc., Wilmington, DE (US)

( * ) Notice: Subject to any disclaimer, the term of this patent is extended or adjusted under 35 U.S.C. 154(b) by 742 days.

(21) Appl. No.: 17/571,627

(22) Filed: Jan. 10, 2022

(65) Prior Publication Data

US 2023/0220607 A1 Jul. 13, 2023

(51) Int. Cl.

| | |
|---|---|
| ***D06F 58/38*** | (2020.01) |
| ***D06F 34/18*** | (2020.01) |
| *D06F 103/04* | (2020.01) |
| *D06F 103/08* | (2020.01) |
| *D06F 103/28* | (2020.01) |
| *D06F 105/32* | (2020.01) |
| *D06F 105/36* | (2020.01) |

(52) U.S. Cl.

CPC ..... *D06F 58/38* (2020.02); *D06F 34/18* (2020.02); *D06F 2103/04* (2020.02); *D06F 2103/08* (2020.02); *D06F 2103/28* (2020.02); *D06F 2105/32* (2020.02); *D06F 2105/36* (2020.02)

(58) Field of Classification Search

None

See application file for complete search history.

(56) References Cited

U.S. PATENT DOCUMENTS

| | | | |
|---|---|---|---|
| 7,478,486 | B2 | 1/2009 | Wunderlin |
| 9,372,031 | B2 | 6/2016 | Contarini |
| 10,443,182 | B2 | 10/2019 | Adkins |
| 2020/0002873 | A1 | 1/2020 | Chae |

FOREIGN PATENT DOCUMENTS

| | | | |
|---|---|---|---|
| JP | 2009095482 | A | 5/2009 |

*Primary Examiner* — Jason Lau

(74) *Attorney, Agent, or Firm* — Dority & Manning, P.A.

(57) ABSTRACT

A dryer appliance, a controller, and a method for operation are provided. The controller is configured to execute steps of a method including receiving an input indicative of a drying cycle end time; determining a moisture extraction rate based at least in part on the received input indicative of drying cycle end time, the moisture extraction rate indicative of a rate at which moisture is removed from articles within a chamber of the dryer appliance; determining a rate of change of moisture extraction rate corresponding to the drying cycle end time; and adjusting a condensation rate based at least on the rate of change of moisture extraction rate and the received input indicative of the drying cycle end time.

20 Claims, 7 Drawing Sheets

DRYER APPLIANCE AND METHOD FOR OPERATION

FIELD

The present subject matter relates generally to dryer appliances, and more particularly to operating closed loop airflow circuit dryer appliances.

BACKGROUND

Closed loop airflow circuit dryer appliances can efficiently dry laundry articles. Example closed loop airflow circuit dryer appliances include condenser dryers, heat pump dryers, and spray tower dryer appliances. Such dryer appliances include a closed loop airflow circuit along which process air is moved. The process air is conditioned by a conditioning system, e.g., to remove moisture from the process air after the air has absorbed water from articles and also heats the air to increase the moisture capacity of the air.

When a drying cycle is complete, articles within the dryer appliance are generally left in place to cool, which may result in wrinkles. A de-wrinkle cycle may run until the user stops the dryer appliance or retrieves the articles. Additionally, running the drying cycle may generate noise and heat that may be undesirable to a user, such as during overnight operation. Furthermore, a user may desire for the drying cycle to end based on a user preference, such as to receive warm, unwrinkled articles from the dryer appliance.

Accordingly, a dryer appliance and methods of operating the same that address one or more of the challenges noted above would be advantageous.

BRIEF DESCRIPTION

Aspects and advantages of the invention will be set forth in part in the following description, or may be obvious from the description, or may be learned through practice of the invention.

An aspect of the present disclosure is directed to a dryer appliance. The dryer appliance includes a cabinet and a drum rotatably mounted within the cabinet. The drum defines a chamber for receipt of a load of articles for drying, the drum defining a drum outlet and a drum inlet to the chamber, a conditioning system configured to heat and remove moisture from process air flowing therethrough. A duct system provides fluid communication between the drum outlet and the conditioning system and between the conditioning system and the drum inlet. The duct system, the conditioning system, and the drum define a process air flowpath. A blower fan is operable to move process air along the process air flowpath. A controller is configured to receive an input indicative of a drying cycle end time; determine, during a drying cycle, a moisture extraction rate based at least in part on the received input indicative of drying cycle end time, the moisture extraction rate indicative of a rate at which moisture is removed from articles within the chamber; determine a rate of change of moisture extraction rate; and adjust a condensation rate at the conditioning system based at least on the rate of change of moisture extraction rate and the received input indicative of the drying cycle end time.

Another aspect of the present disclosure is directed to a controller for a dryer appliance. The controller is configured to store instructions that, when executed, causes the dryer appliance to perform operations. The operations include receiving an input indicative of a drying cycle end time; determining a moisture extraction rate based at least in part on the received input indicative of drying cycle end time, the moisture extraction rate indicative of a rate at which moisture is removed from articles within a chamber of the dryer appliance; determining a rate of change of moisture extraction rate corresponding to the drying cycle end time; and adjusting a condensation rate based at least on the rate of change of moisture extraction rate and the received input indicative of the drying cycle end time.

Yet another aspect of the present disclosure is directed to a method for operating a dryer appliance. The method includes receiving an input indicative of a drying cycle end time; determining a moisture extraction rate based at least in part on the received input indicative of drying cycle end time, the moisture extraction rate indicative of a rate at which moisture is removed from articles within a chamber of the dryer appliance; determining a rate of change of moisture extraction rate corresponding to the drying cycle end time; and adjusting a condensation rate based at least on the rate of change of moisture extraction rate and the received input indicative of the drying cycle end time.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
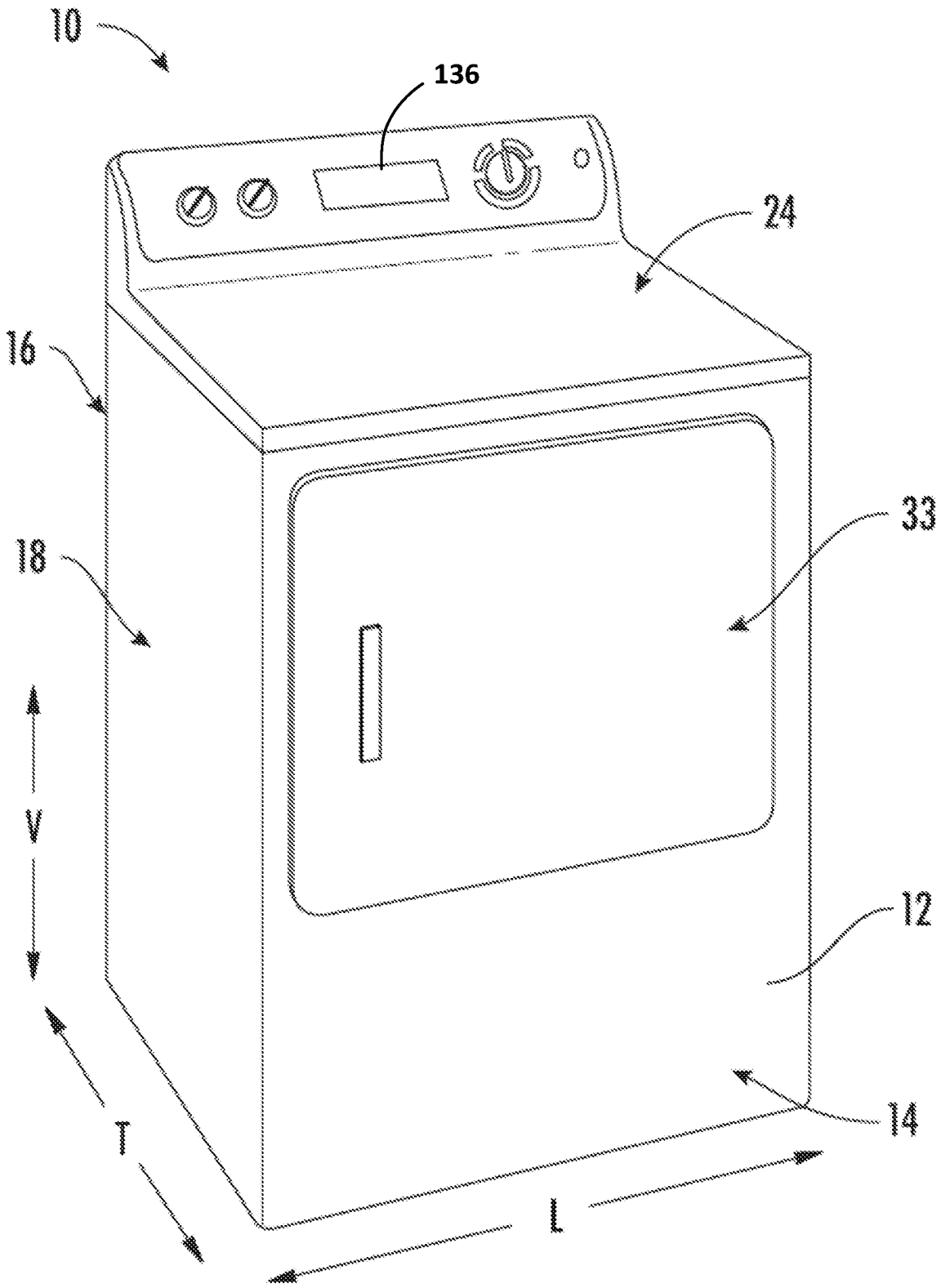
FIG. 1 provides a perspective view of a dryer appliance in accordance with exemplary embodiments of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first," "second," and "third" may be used interchangeably to distinguish one component from another and are not intended to signify location or importance of the individual components. The terms "includes" and "including" are intended to be inclusive in a manner similar to the term "comprising." Similarly, the term "or" is generally intended to be inclusive (i.e., "A or B" is intended to mean "A or B or both"). In addition, here and throughout the specification and claims, range limitations may be combined or interchanged. Such ranges are identified and include all the sub-ranges contained therein unless context or language indicates otherwise. For example, all ranges disclosed herein are inclusive of the endpoints, and the endpoints are independently combinable with each other. The singular forms "a," "an," and "the" include plural references unless the context clearly dictates otherwise.

Approximating language, as used herein throughout the specification and claims, may be applied to modify any quantitative representation that could permissibly vary without resulting in a change in the basic function to which it is related. Accordingly, a value modified by a term or terms, such as "generally," "about," "approximately," and "substantially," are not to be limited to the precise value specified. In at least some instances, the approximating language may correspond to the precision of an instrument for measuring the value, or the precision of the methods or machines for constructing or manufacturing the components or systems. For example, the approximating language may refer to being within a 10 percent margin (i.e., including values within ten percent greater or less than the stated value). In this regard, for example, when used in the context of an angle or direction, such terms include within ten degrees greater or less than the stated angle or direction (e.g., "generally vertical" includes forming an angle of up to ten degrees in any direction, such as, clockwise or counterclockwise, with the vertical direction V).

The word "exemplary" is used herein to mean "serving as an example, instance, or illustration." In addition, references to "an embodiment" or "one embodiment" does not necessarily refer to the same embodiment, although it may. Any implementation described herein as "exemplary" or "an embodiment" is not necessarily to be construed as preferred or advantageous over other implementations. Moreover, each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

Embodiments of a method, a controller, and a dryer appliance are provided herein. Embodiments provided herein allow a user to select a delay end cycle, such as a drying cycle end time, that may utilize one or more of a load size, a load type, moisture data, or historical moisture extraction rate to determine a drying cycle duration corresponding to the drying cycle end time. A heater element, such as a heat pump compressor, and a blower fan speed can be adjusted based on the desired drying cycle end time, allowing for reduced dryer appliance noise and articles dried within the dryer appliance at the desired end time of the user.

Embodiments of the method for operating a dryer appliance, and a controller configured to perform operations, include receiving an input indicative of a drying cycle end time; determining a moisture extraction rate based at least in part on the received input indicative of drying cycle end time, the moisture extraction rate indicative of a rate at which moisture is removed from articles within a chamber of the dryer appliance; determining a rate of change of moisture extraction rate corresponding to the drying cycle end time; and adjusting a condensation rate based at least on the rate of change of moisture extraction rate and the received input indicative of the drying cycle end time.

Various embodiments may include receiving a dry load weight; receiving a wetted load weight; and determining an amount of fluid to be removed from the load of articles based at least on a difference between the dry load weight and the wetted load weight. In certain embodiments, the controller is operably coupled to a combination washer/dryer appliance. In other embodiments, the controller is communicatively coupled to the dryer appliance and a washer appliance, either separately or as a washer/dryer combination (e.g., a top-bottom arrangement of washer and dryer appliances). Accordingly, the controller may be configured to receive the dry load weight and receive the wetted load weight is from the washer appliance. The method may include determining an initial condensation rate of the drying cycle based on the input indicative of the drying cycle end time and the amount of fluid to be removed from the load of articles. The method may include determining a load type based at least on the difference between the dry load weight and the wetted load weight compared to the dry load weight. Adjusting the condensation rate may be based at least on the determined load type and the amount of fluid to be removed from the load of articles. Accordingly, the condensation rate is adjusted to complete the drying cycle corresponding to the received input drying cycle end time.

In certain embodiments, the method includes monitoring an input temperature or an input moisture of air into the chamber of the dryer appliance, such as via a temperature or humidity sensor positioned at an inlet flowpath to the chamber. The method may further include monitoring an output temperature or an output moisture of air from the chamber, such as via a temperature or humidity sensor positioned at an outlet flowpath from the chamber. The moisture extraction rate may be determined based on a difference between the input temperature and the output temperature or a difference between the input moisture and the output moisture.

Accordingly, the rate of change of moisture extraction rate to correspond to the desired cycle end time is achieved by adjusting the condensation rate.

Various embodiments of the method may include adjusting the condensation rate based on the rate of change of moisture extraction rate corresponding to the drying cycle end time or adjusting, at a blower fan at the conditioning system of the dryer appliance, a flowrate of process air through the conditioning system based on the rate of change of moisture extraction rate corresponding to the drying cycle end time. The condensation rate may be adjusted in accordance with the determined rate of change of moisture extraction rate necessary to achieve the desired drying cycle end time.

The method may further include stopping the drying cycle at the drying cycle end time. User may accordingly receive articles dried at the desired drying cycle end time. Embodiments of the method may contrast to operating de-wrinkle or intermittent cycles prior to user retrieving the articles.

Steps of the method for control provided herein may allow the dryer appliance to operate with a lower energy usage or reduced flowrate of process air, allowing for reduced noise during the drying cycle. Such noise reduction may be beneficial and advantageous when a user operates the dryer appliance overnight, or may desire warm clothes at a desired time. Such methods of operation may be particularly beneficial in colder climates and cold weather, such as to allow a user to have warm clothes after an overnight drying cycle.

Figure 2:
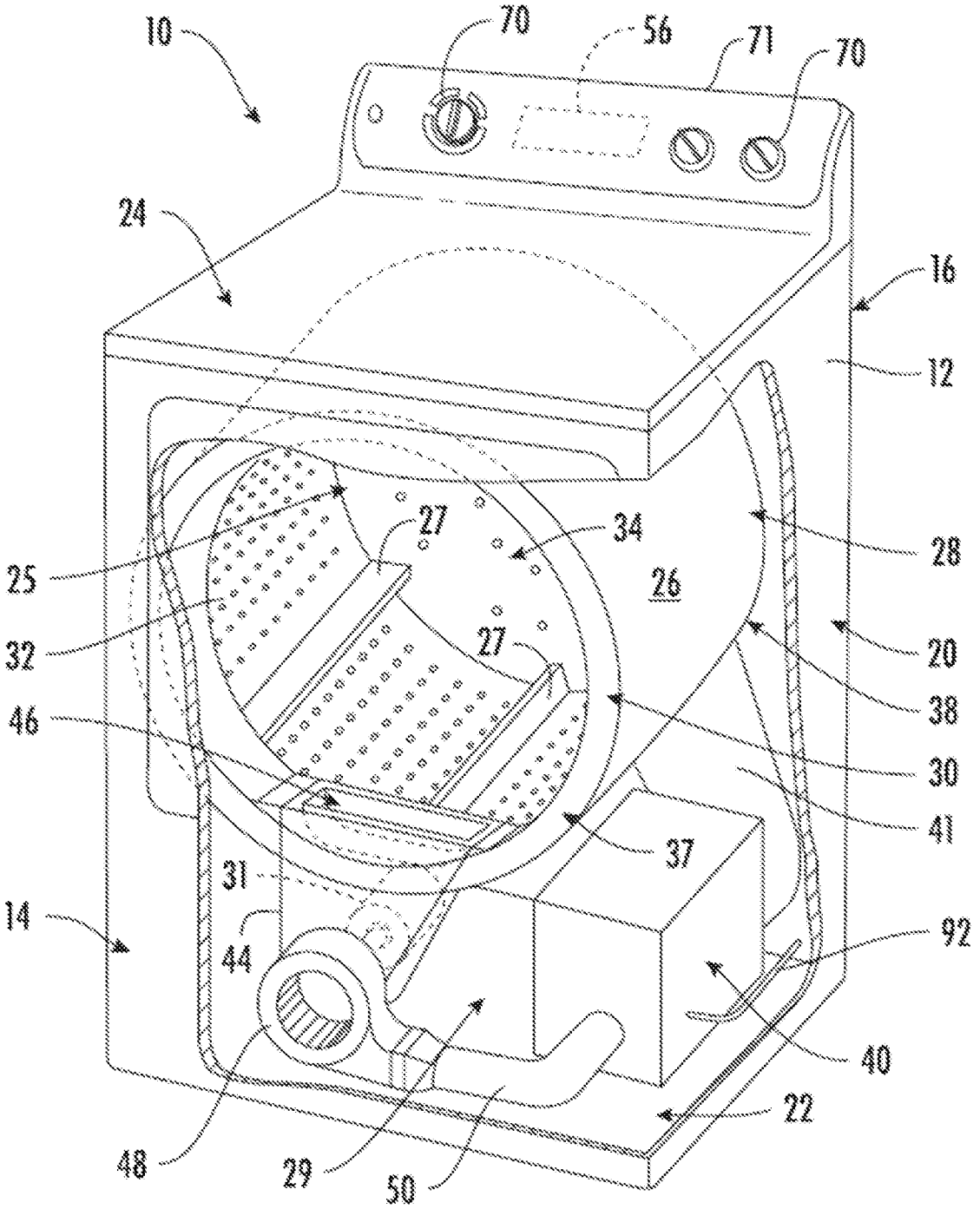
FIG. 2 provides a perspective view of the example dryer appliance of FIG. 1 with portions of a cabinet of the dryer appliance removed to reveal certain components of the dryer appliance.

FIGS. 1 and 2 provide perspective views of a dryer appliance 10 according to exemplary embodiments of the present disclosure. Particularly, FIG. 1 provides a perspective view of dryer appliance 10 and FIG. 2 provides another perspective view of dryer appliance 10 with a portion of a housing or cabinet 12 of dryer appliance 10 removed in order to show certain components of dryer appliance 10. As depicted, dryer appliance 10 defines a vertical direction V, a lateral direction L, and a transverse direction T, each of which is mutually perpendicular such that an orthogonal coordinate system is defined. While described in the context of a specific embodiment of dryer appliance 10, using the teachings disclosed herein it will be understood that dryer appliance 10 is provided by way of example only. Other dryer appliances having different appearances and different features may also be utilized with the present subject matter as well. For instance, in some embodiments, dryer appliance 10 can be a combination washing machine/dryer appliance.

Cabinet 12 includes a front panel 14, a rear panel 16, a pair of side panels 18 and 20 spaced apart from each other by front and rear panels 14 and 16 along the lateral direction L, a bottom panel 22, and a top cover 24. Cabinet 12 defines an interior volume 29. A drum or container 26 is mounted for rotation about a substantially horizontal axis within the interior volume 29 of cabinet 12. Drum 26 defines a chamber 25 for receipt of articles for tumbling or drying. Drum 26 extends between a front portion 37 and a back portion 38, e.g., along the transverse direction T. Drum 26 also includes a back or rear wall 34, e.g., at back portion 38 of drum 26. A supply duct 41 may be mounted to rear wall 34. Supply duct 41 receives heated air that has been heated by a conditioning system 40 and provides the heated air to drum 26 via one or more holes defined by rear wall 34.

As used herein, the terms "clothing" or "articles" includes but need not be limited to fabrics, textiles, garments, linens, papers, or other items from which the extraction of moisture is desirable. Furthermore, the term "load" or "laundry load" refers to the combination of clothing that may be washed together in a washing machine or dried together in a dryer appliance 10 (e.g., clothes dryer) and may include a mixture of different or similar articles of clothing of different or similar types and kinds of fabrics, textiles, garments and linens within a particular laundering process.

In some embodiments, a motor 31 is provided to rotate drum 26 about the horizontal axis, e.g., via a pulley and a belt (not pictured). Drum 26 is generally cylindrical in shape. Drum 26 has an outer cylindrical wall 28 and a front flange or wall 30 that defines an opening 32 of drum 26, e.g., at front portion 37 of drum 26, for loading and unloading of articles into and out of chamber 25 of drum 26. Drum 26 includes a plurality of lifters or baffles 27 that extend into chamber 25 to lift articles therein and then allow such articles to tumble back to a bottom of drum 26 as drum 26 rotates. Baffles 27 may be mounted to drum 26 such that baffles 27 rotate with drum 26 during operation of dryer appliance 10.

Rear wall 34 of drum 26 is rotatably supported within cabinet 12 by a suitable bearing. Rear wall 34 can be fixed or can be rotatable. Rear wall 34 may include, for instance, a plurality of holes that receive hot air that has been heated by a conditioning system 40, e.g., a heat pump or refrigerant-based conditioning system as will be described further below. Moisture laden, heated air is drawn from drum 26 by an air handler, such as a blower fan 48, which generates a negative air pressure within drum 26. The moisture laden heated air passes through an outlet duct 44 enclosing screen filter 46, which traps lint particles. As the air passes from blower fan 48, it enters a duct 50 and then is passed into conditioning system 40. In some embodiments, the conditioning system 40 may be or include an electric heating element, e.g., a resistive heating element, or a gas-powered heating element, e.g., a gas burner. In the embodiment depicted, dryer appliance 10 is a heat pump dryer appliance and thus conditioning system 40 may be or include a heat pump including a sealed refrigerant circuit, as described in more detail below with reference to FIG. 3. However, regarding methods for operating the dryer appliance provided herein, any appropriate configuration of conditioning system, heating element, or dryer appliance may be utilized. Heated air (with a lower moisture content than was received from drum 26), exits conditioning system 40 and returns to drum 26 by duct 41. After the clothing articles have been dried, they are removed from the drum 26 via opening 32. A door 33 provides for closing or accessing drum 26 through opening 32.

In some embodiments, one or more selector inputs 70, such as knobs, buttons, touchscreen interfaces, etc., may be provided or mounted on a cabinet 12 (e.g., on a backsplash 71) and are communicatively coupled with (e.g., electrically coupled or coupled through a wireless network band) a processing device or controller 56. Controller 56 may also be communicatively coupled with various operational components of dryer appliance 10, such as motor 31, blower 48, conditioning system 40, sensors 102, 104 or components of conditioning system 40. In turn, signals generated in controller 56 direct operation of motor 31, blower 48, or conditioning system 40 in response user inputs to selector inputs 70 or user interface panel 136. As used herein, "processing device" or "controller" may refer to one or more microprocessors, microcontroller, ASICS, or semiconductor devices and is not restricted necessarily to a single element. The controller 56 may be programmed to operate dryer appliance 10 by executing instructions stored in memory (e.g., non-transitory media), such as outlined as steps of method 1000 provided further herein.

The controller 56 may include, or be associated with, one or more memory elements such as RAM, ROM, or electrically erasable, programmable read only memory (EE- PROM). For example, the instructions may be software or any set of instructions that when executed by the processing device, cause the processing device to perform operations. It should be noted that controller 56 as disclosed herein is capable of and may be operable to perform any methods or associated method steps as disclosed herein. For example, in some embodiments, methods disclosed herein may be embodied in programming instructions stored in the memory and executed as operations by the controller 56.

Figure 3:
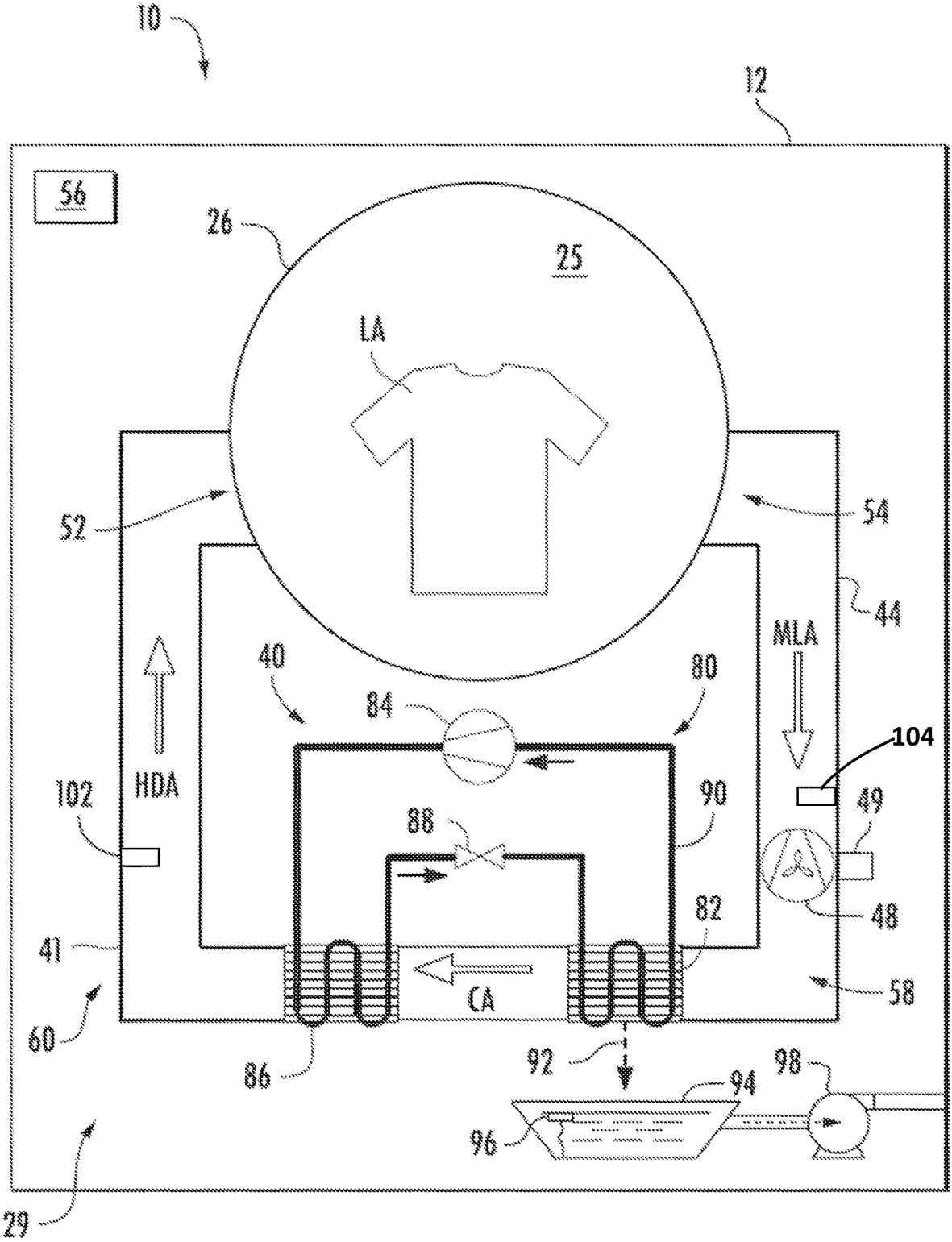
FIG. 3 provides a schematic diagram of an exemplary heat pump dryer appliance and a conditioning system thereof in accordance with exemplary embodiments of the present disclosure.

FIG. 3 provides a schematic view of dryer appliance 10 and depicts conditioning system 40 in more detail. For this embodiment, dryer appliance 10 is a heat pump dryer appliance and thus conditioning system 40 includes a sealed system 80. Sealed system 80 includes various operational components, which can be encased or located within a machinery compartment of dryer appliance 10. Generally, the operational components are operable to execute a vapor compression cycle for heating process air passing through conditioning system 40. The operational components of sealed system 80 include an evaporator 82, a compressor 84, a condenser 86, and one or more expansion devices 88 connected in series along a refrigerant circuit or line 90. In particular embodiments, compressor 84 is a variable speed compressor. Refrigerant line 90 is charged with a working fluid, which in this example is a refrigerant. Sealed system 80 depicted in FIG. 3 is provided by way of example only. Thus, it is within the scope of the present subject matter for other configurations of the sealed system to be used as well. As will be understood by those skilled in the art, sealed system 80 may include additional components, e.g., at least one additional evaporator, compressor, expansion device, or condenser. As an example, sealed system 80 may include two (2) evaporators.

Mass flow rate of refrigerant is a function of refrigerant volumetric flow rate and refrigerant density. Volumetric flow rate is a function of speed and displacement of compressor 84. Density is a function of refrigerant temperature at an inlet of compressor 84. In various embodiments, a Joule heater may be included to increase the refrigerant temperature, which may increase density and increase refrigerant mass flow rate. The increased mass flow rate allows for increased condensing capacity and increased process air temperature. The increased process air temperature allows for increased moisture extraction capacity. Compressor 84 including a variable speed compressor may allow for variable speeds, such as to allow the Joule heater to increase refrigerant temperature while maintaining system balance.

In performing a drying or tumbling cycle, one or more laundry articles LA may be placed within the chamber 25 of drum 26. Hot dry air HDA is supplied to chamber 25 via duct 41. The hot dry air HDA enters chamber 25 of drum via a drum inlet 52 defined by drum 26, e.g., the plurality of holes defined in rear wall 34 of drum 26 as shown in FIG. 2. The hot dry air HDA provided to chamber 25 causes moisture within laundry articles LA to evaporate. Accordingly, the air within chamber 25 increases in water content and exits chamber 25 as warm moisture laden air MLA. The warm moisture laden air MLA exits chamber 25 through a drum outlet 54 defined by drum 26 and flows into outlet duct 44.

After exiting chamber 25 of drum 26, the warm moisture laden air MLA flows downstream to conditioning system 40. Blower fan 48 moves the warm moisture laden air MLA, as well as the air more generally, through a process air flowpath 58 defined by drum 26, conditioning system 40, and the duct system 60. Thus, generally, blower fan 48 is operable to move air through or along the process air flowpath 58. Duct system 60 includes all ducts that provide fluid communication (e.g., airflow communication) between drum outlet 54 and conditioning system 40 and between conditioning system 40 and drum inlet 52. Although blower fan 48 is shown positioned between drum 26 and conditioning system 40 along duct outlet 44, it will be appreciated that blower fan 48 can be positioned in other suitable positions or locations along duct system 60.

As further depicted in FIG. 3, the warm moisture laden air MLA flows into or across evaporator 82 of the conditioning system 40. As the moisture-laden air MLA passes across evaporator 82, the temperature of the air is reduced through heat exchange with refrigerant that is vaporized within, for example, coils or tubing of evaporator 82. This vaporization process absorbs both the sensible and the latent heat from the moisture-laden air MLA—thereby reducing its temperature. As a result, moisture in the air is condensed and such condensate water may be drained from conditioning system 40, e.g., using a drain line 92, which is also depicted in FIG. 2.

For this embodiment, a collection tank 94 is in fluid communication with conditioning system 40, e.g., via drain line 92. Collection tank 94 is operable to receive condensate water from the process air flowing through conditioning system 40, and more particularly, condensate water from evaporator 82. A sensor 96 operable to detect when water within collection tank 94 has reached a predetermined level. Sensor 96 can be any suitable type of sensor, such as a float switch as shown in FIG. 3. Sensor 96 can be communicatively coupled with controller 56, e.g., via a suitable wired or wireless communication link. A drain pump 98 is in fluid communication with collection tank 94. Drain pump 98 is operable to remove a volume of water from collection tank 94. In some embodiments, drain pump 98 can remove a known or predetermined volume of water from collection tank 94. Drain pump 98 can remove the condensate water from collection tank 94 and can move or drain the condensate water downstream, e.g., to a gray water collection system. Particularly, in some embodiments, controller 56 is configured to receive, from sensor 96, an input indicating that water within the collection tank has reached the predetermined level. In response to the input indicating that water within collection tank 94 has reached the predetermined level, controller 56 can cause drain pump 98 to remove the predetermined volume of water from collection tank 94.

Air passing over evaporator 82 becomes cooler than when it exited drum 26 at drum outlet 54. As shown in FIG. 3, cool air CA (cool relative to hot dry air HDA and moisture laden air MLA) flowing downstream of evaporator 82 is subsequently caused to flow across condenser 86, e.g., across coils or tubing thereof, which condenses refrigerant therein. The refrigerant enters condenser 86 in a gaseous state at a relatively high temperature compared to the cool air CA from evaporator 82. As a result, heat energy is transferred to the cool air CA at the condenser 86, thereby elevating its temperature and providing warm dry air HDA for resupply to drum 26 of dryer appliance 10. The warm dry air HDA passes over and around laundry articles LA within the chamber 25 of the drum 26, such that warm moisture laden air MLA is generated, as mentioned above. Because the air is recycled through drum 26 and conditioning system 40, dryer appliance 10 can have a much greater efficiency than traditional clothes dryers can where all of the warm, moisture-laden air MLA is exhausted to the environment.

With respect to sealed system 80, compressor 84 pressurizes refrigerant (i.e., increases the pressure of the refrigerant) passing therethrough and generally motivates refrigerant through the sealed refrigerant circuit or refrigerant line 90 of conditioning system 40. Compressor 84 may be communicatively coupled with controller 56 (communication lines not shown in FIG. 3). Refrigerant is supplied from the evaporator 82 to compressor 84 in a low pressure gas phase. The pressurization of the refrigerant within compressor 84 increases the temperature of the refrigerant. The compressed refrigerant is fed from compressor 84 to condenser 86 through refrigerant line 90. As the relatively cool air CA from evaporator 82 flows across condenser 86, the refrigerant is cooled and its temperature is lowered as heat is transferred to the air for supply to chamber 25 of drum 26.

Upon exiting condenser 86, the refrigerant is fed through refrigerant line 90 to expansion device 88. Although only one expansion device 88 is shown, such is by way of example only. It is understood that multiple such devices may be used. In the illustrated example, expansion device 88 is an electronic expansion valve, although a thermal expansion valve or any other suitable expansion device can be used. In additional embodiments, any other suitable expansion device, such as a capillary tube, may be used as well. Expansion device 88 lowers the pressure of the refrigerant and controls the amount of refrigerant that is allowed to enter the evaporator 82. Importantly, the flow of liquid refrigerant into evaporator 82 is limited by expansion device 88 in order to keep the pressure low and allow expansion of the refrigerant back into the gas phase in evaporator 82. The evaporation of the refrigerant in evaporator 82 converts the refrigerant from its liquid-dominated phase to a gas phase while cooling and drying the moisture laden air MLA received from chamber 25 of drum 26. The process is repeated as air is circulated along process air flowpath 58 while the refrigerant is cycled through sealed system 80, as described above.

Although dryer appliance 10 is depicted and described herein as a heat pump dryer appliance, the inventive aspects of the present disclosure can apply to other types of closed loop airflow circuit dryer appliances. For instance, in other embodiments, dryer appliance 10 can be a condenser dryer that utilizes an air-to-air heat exchanger instead of evaporator 82 or heater element, such as an electric heater or gas heater, may be provided instead of condenser 86. Thus, in such embodiments, the working fluid that interacts thermally with the process air may be air. In yet other embodiments, dryer appliance 10 can be a spray tower dryer appliance that utilizes a water-to-air heat exchanger instead of utilizing a sealed refrigerant. Thus, in such embodiments, the working fluid that interacts thermally with the process air may be water. Further, in some embodiments, dryer appliance 10 can be a combination washer/dryer appliance having a closed loop airflow circuit along which process air may flow for drying operations.

With reference to FIG. 3, generally, a drying cycle includes three (3) states or phases, including a warm up state, a steady state, and a diminished drying state. In the warm up state, the process air flowing along the closed loop process air flowpath 58 is brought to temperature by conditioning system 40, or more particularly for this embodiment, heat pump sealed system 80. With the temperatures and pressures of the process air and refrigerant relatively stabilized, the drying cycle transitions to the steady state phase of the cycle. The steady state phase of the drying cycle is indicative of a part of the drying cycle in which an article water dissipation rate exceeds the moisture extraction rate. The article water dissipation rate is a rate at which articles LA within chamber 25 of drum 26 dissipate water to the process air flowing along the process air flowpath 58. The moisture extraction rate is the rate at which moisture is removed or extracted from the process air, e.g., at evaporator 82. In the steady state phase of the drying cycle, controller 56 seeks to optimize (e.g., maximize) the moisture extraction rate. The diminished drying state of the drying cycle is indicative of a part of the drying cycle in which the moisture extraction rate exceeds the article water dissipation rate. Inefficiency can result during the diminished drying state when evaporator 82 has unusable capacity. However, in accordance with the inventive aspects of the present disclosure, dryer appliance 10 can make adjustments to one or more one or more drying cycle settings to address such inefficiencies. Operation of dryer appliance 10 in the steady state and diminished drying state phases will be explained more fully below.

During the steady state phase of the drying cycle, process air flows along the process air flowpath 58 and refrigerant flows along sealed system 80 as described above. Moreover, during the steady state phase of the drying cycle, controller 56 seeks to optimize (e.g., maximize) the moisture extraction rate and to match the evaporator capacity with the moisture extraction rate to maximize efficiency. To accomplish these goals, controller 56 is configured to receive an input indicative of a rate at which water is removed from the process air by conditioning system 40. Controller 56 is also configured to determine a moisture extraction rate indicative of a rate at which moisture is removed from articles LA within chamber 25 of drum 26 based at least in part on the rate at which water is removed from process air by conditioning system 40. Controller 56 is then configured to cause adjustment of one or more drying cycle settings based at least in part on the determined moisture extraction rate.

In some embodiments, pump activation frequency of drain pump 98 is indicative of moisture extraction rate. The pump activation frequency is indicative of a frequency at which drain pump 98 is activated to remove water from the collection tank 94. In such embodiments, controller 56 measures the moisture extraction rate based at least in part on the pump activation frequency.

Figure 6:
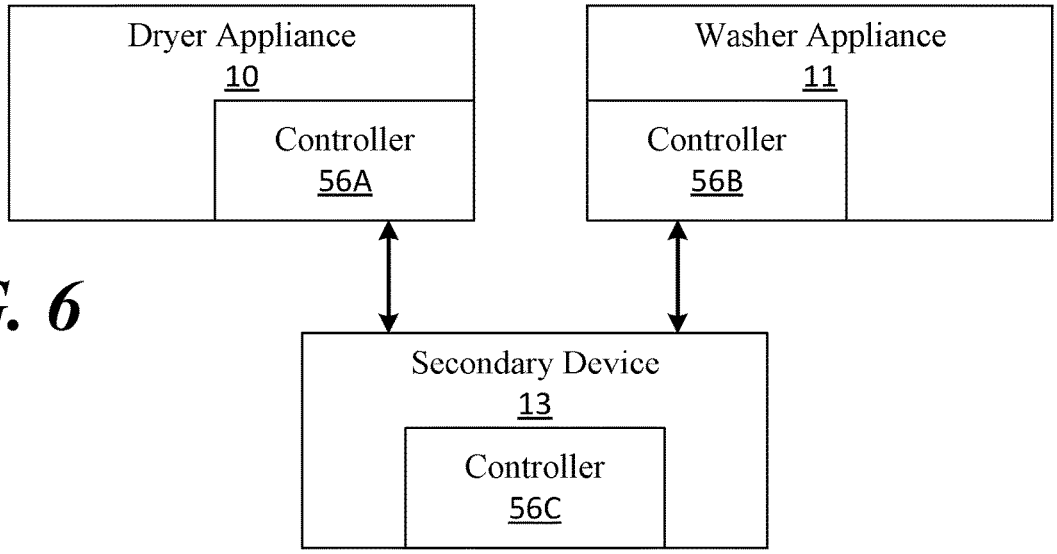
FIG. 6 is a schematic depiction of a communications network of a dryer appliance, a washer appliance, and a secondary device in accordance with exemplary embodiments of the present disclosure.
Figure 7:
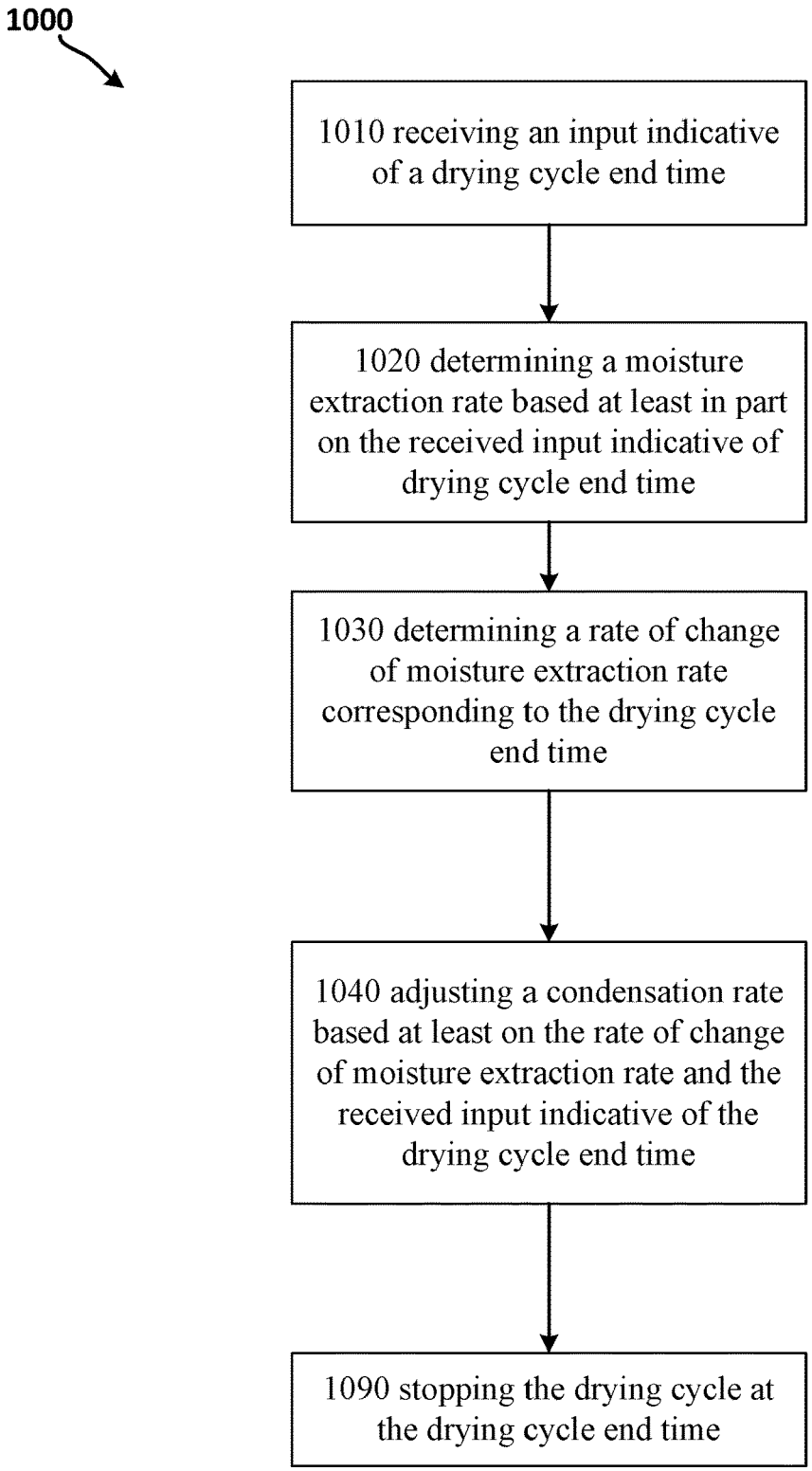
FIG. 7 is a flowchart outlining steps of a method for operating a dryer appliance in accordance with exemplary embodiments of the present disclosure.
Figure 8:
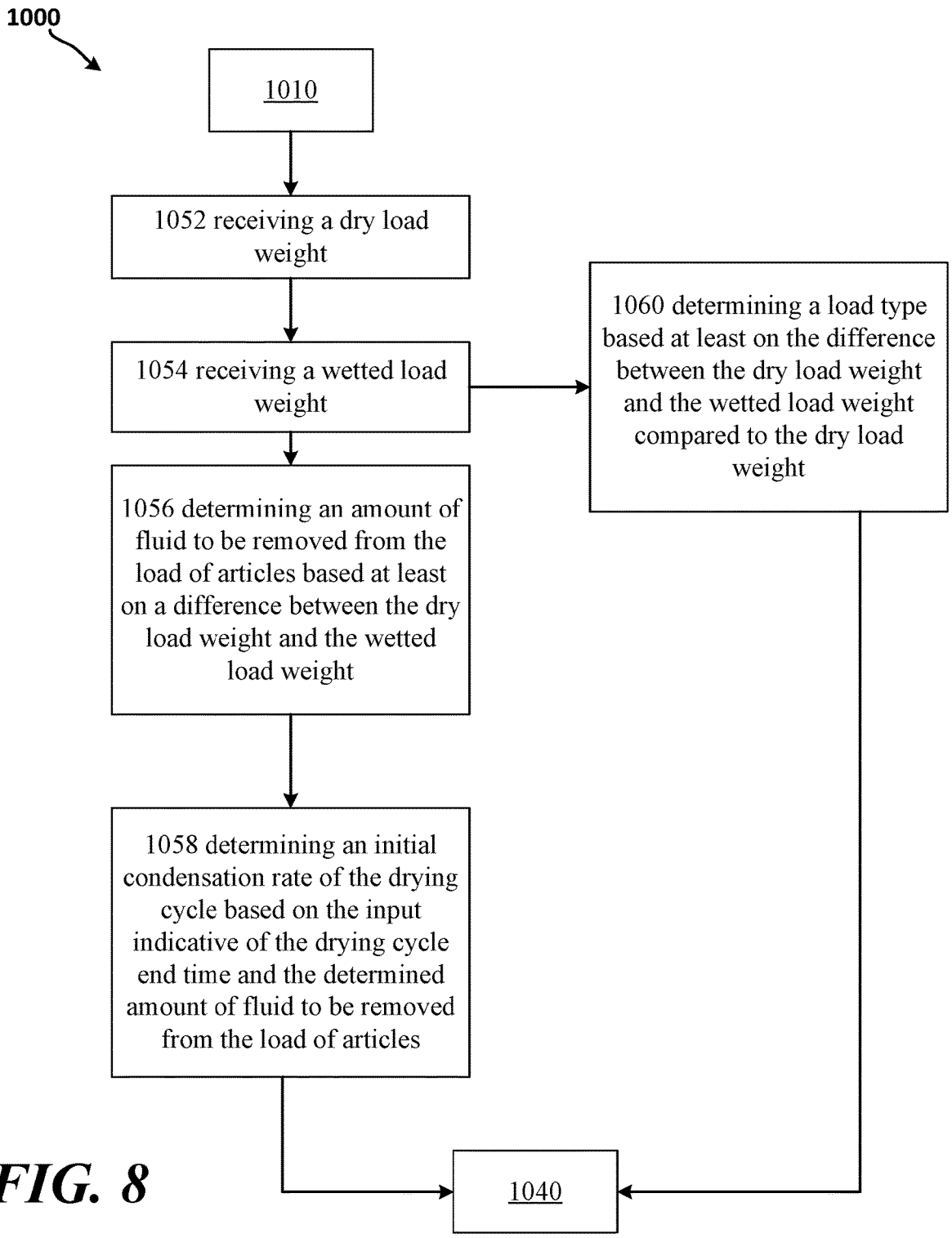
FIG. 8 is a flowchart outlining steps of a method for operating a dryer appliance in accordance with exemplary embodiments of the present disclosure.
Figure 9:
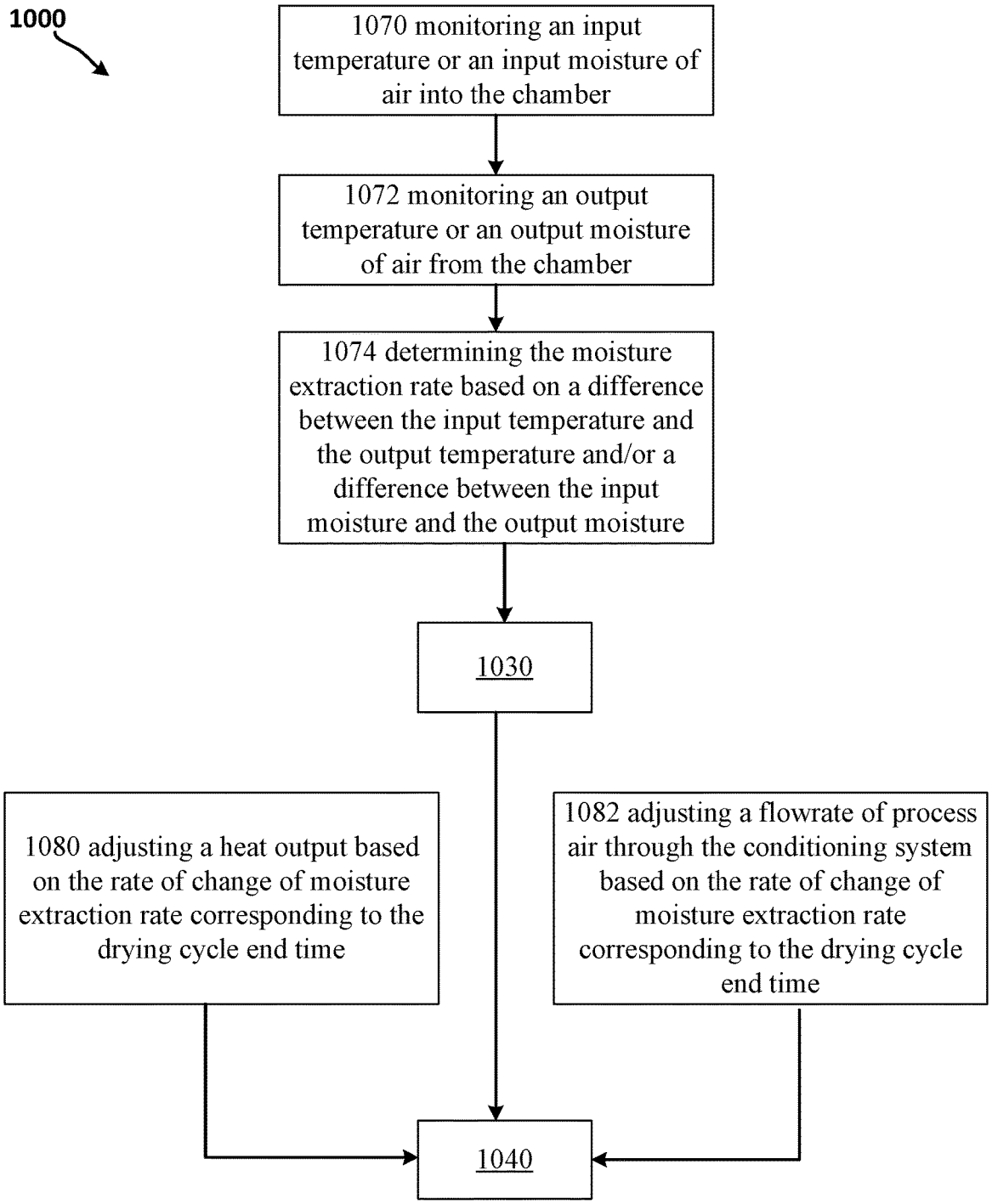
FIG. 9 is a flowchart outlining steps of a method for operating a dryer appliance in accordance with exemplary embodiments of the present disclosure.

FIGS. 7 through 9 provide a flowchart outlining steps of a method for operating a dryer appliance is provided ("method 1000"). Steps of method 1000 may be stored as instructions at a controller, such as controller 56, that, when executed, causes a dryer appliance (e.g., dryer appliance 10) to perform operations in accordance with steps of method 1000. Steps of method 1000 may additionally cause a washer appliance (e.g., washer appliance 11 in FIGS. 4 through 6) to perform operations in accordance with steps of method 1000. Accordingly, operations may include one or more steps of method 1000 such as outlined herein. Although reference will be made to particular portions of the dryer appliance 10, such as provided in regard to FIGS. 1 through 3, it should be appreciated that the controller 56 may be utilized with other dryer appliances and washer appliances, and steps of method 1000 may be executed with other dryer and washer appliances.

Referring now to FIGS. 1 through 9, method 1000 includes at 1010 receiving an input indicative of a drying cycle end time. The input may be received at the controller 56, such as knobs, buttons, touchscreen interfaces, etc., provided via selector inputs 70 mounted on cabinet 12. The drying cycle end time may be provided as a discrete time (e.g., 6 am, 630 am, 7 am, etc.). The drying cycle end time may particularly define a time at which a user desires the drying cycle to be completed. For instance, the drying cycle end time may allow for drying cycles over several hours, such as, but not limited to, three hours, or more. The drying cycle end time may contrast with a timed drying function configured to dry articles for an elapsed period of time (e.g., 30 minutes, 40 minutes, 60 minutes, 75 minutes, etc.), generally at constant temperature or flowrate conditions without regard for changing process air conditions at the chamber 25, dryness of articles, fabric type, etc. The drying cycle end time may contrast with a delayed cycle start function, in which a drying cycle may delay start, proceed through the drying cycle, and end following the drying cycle. Still further, the drying cycle end time may contrast with running a drying cycle followed by a wrinkle-release cycle that may operate the drum 26 to rotate and tumble articles without providing heat for drying the articles.

Method 1000 includes at 1020 determining a moisture extraction rate based at least in part on the received input indicative of drying cycle end time (e.g., method 1000 at 1010). The moisture extraction rate is indicative of a rate at which moisture is removed from articles within a chamber (e.g., chamber 25) of the dryer appliance. The moisture extraction rate may be a function of temperature or thermal load from the conditioning system 40 (e.g., one or more heater elements providing heat to generate hot dry air HDA) or process air flowrate based, at least in part, on blower fan 48 operation. The moisture extraction rate may additionally be a function of time and moisture content at the laundry articles LA during operation of the dryer appliance 10.

Method 1000 includes at 1030 determining a rate of change of moisture extraction rate corresponding to the drying cycle end time. The rate of change of moisture extraction rate may include an acceleration or deceleration of the rate of moisture extraction. The rate of change of the moisture extraction rate may be a function of change in temperature or thermal load from the conditioning system 40 (e.g., one or more heater elements providing heat to generate hot dry air HDA) or change in process air flowrate based, at least in part, on blower fan 48 operation.

Method 1000 includes at 1040 adjusting a condensation rate based at least on the rate of change of moisture extraction rate and the received input indicative of the drying cycle end time. Adjusting the condensation rate may include adjusting the condensation rate at the evaporator (e.g., evaporator 82) to adjust moisture extraction rate. The method 1000 at 1040 may include adjusting operation of the compressor (e.g., compressor 84) to adjust condenser heat, such as to adjust moisture extraction rate. Additionally, or alternatively, the method 1000 at 1040 may include adjusting operation of the fan (e.g., blower fan 48) to adjust moisture extraction rate. Adjusting the condensation rate may include adjusting a mass flow rate of process air through the conditioning system. In particular embodiments, adjusting the condensation rate adjusts the rate of change of moisture extraction rate at the process air. Process air includes one or more of moisture laden air MLA, cool air CA, or heated dry air HDA flowing through a conditioning system (e.g., conditioning system 40) of the dryer appliance, such as described regarding FIGS. 1 through 3.

In various embodiments, method 1000 includes at 1052 receiving a dry load weight, at 1054 receiving a wetted load weight, and at 1056 determining an amount of fluid to be removed from the load of articles based at least on a difference between the dry load weight and the wetted load weight. In certain embodiments, controller 56 is configured to receive the dry load weight at 1052 and receive the wetted load weight at 1054 from a washer appliance. The controller (e.g., controller 56) may be communicatively coupled to the dryer appliance and the washer appliance separately, or as a washer/dryer combination (e.g., a top-bottom arrangement of washer and dryer appliances). In certain embodiments, controller 56 includes a wireless communications device, a wired communications bus, or other communications device, configured to send or receive signals, data, or other information between components of the dryer appliance 10 and one or more of the washer appliance 11 or a secondary device 13.

Figure 4:
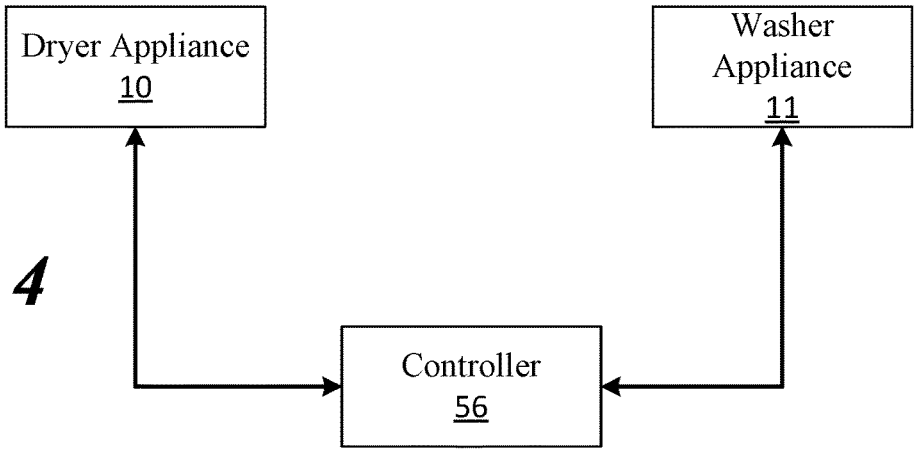
FIG. 4 is a schematic depiction of a communications network of a dryer appliance, a washer appliance, and a controller in accordance with exemplary embodiments of the present disclosure.
Figure 5:
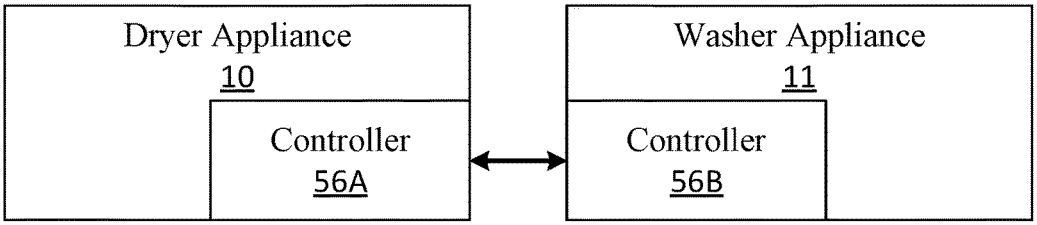
FIG. 5 is a schematic depiction of a communications network of a dryer appliance, a washer appliance, and a controller in accordance with exemplary embodiments of the present disclosure.

Referring briefly to FIGS. 4 through 6, it should be appreciated that a plurality of controllers 56, such as controller 56A for dryer appliance 10, controller 56B for washer appliance 11, or controller 56C for the secondary device 13, may include communications busses, wired communications devices, or wireless communications devices, that may be programmed to communicate with controller(s). Wireless communications devices may include one or more of Wi-Fi, Bluetooth®, ZigBee®, or similar type of wireless communications technologies and networks. Controller(s) may be configured to communicate between dryer appliance 10, washer appliance 11, or a secondary device controller 56C while running a program that provides for user input. In this context, secondary devices 13 such as, but not limited to, smartphones, tablet devices, and standalone devices may be used to implement the present subject matter. In particular embodiments, secondary device 13 may include smartphones, table devices, smart speakers, internet-enabled or intranet-enabled control devices, Internet of Things (IoT) devices, or other appropriate devices.

Referring back to FIGS. 1 through 9, in certain embodiments, method 1000 includes at 1058 determining an initial condensation rate of the drying cycle based on the input indicative of the drying cycle end time and the determined amount of fluid to be removed from the load of articles.

Method 1000 may include at 1060 determining a load type based at least on the difference between the dry load weight and the wetted load weight compared to the dry load weight. In such embodiments, adjusting the condensation rate at 1040 may including adjusting a mass flow rate of process air based on the determined load type at 1060 and the determined amount of fluid at 1056 to be removed from the load of articles. Accordingly, the condensation rate may be a function of compressor speed (e.g., compressor 84) and/or fan speed (e.g., blower fan 48), such as to adjust the moisture extraction rate to complete the drying cycle corresponding to the received input drying cycle end time.

In various embodiments, method 1000 includes at 1070 monitoring an input temperature or an input moisture of air (e.g., hot dry air HDA) into the chamber (e.g., chamber 25) of the dryer appliance, such as via a temperature or humidity sensor (e.g., sensor 102) positioned at an inlet flowpath (e.g., at supply duct 41) to the chamber. Method 1000 may further include at 1072 monitoring an output temperature or an output moisture of air (e.g., moisture laden air MLA) from the chamber, such as via a temperature or humidity sensor (e.g., sensor 104) positioned at an outlet flowpath (e.g., outlet duct 44) from the chamber. Method 1000 may include at 1074 determining the moisture extraction rate based on a difference between the input temperature and the output temperature or a difference between the input moisture and the output moisture. Accordingly, the determined rate of change of moisture extraction rate at 1030 to correspond to the desired cycle end time at 1010 may be performed by adjusting the condensation rate at 1040 as a temperature or thermal load from a heater element or as a flowrate of process air carrying the heat.

Certain embodiments of method 1000 may include at 1080 adjusting, at the conditioning system (e.g., conditioning system 40, at condenser 86, or at a heater element generally) of the dryer appliance, a heat output based on the rate of change of moisture extraction rate corresponding to the drying cycle end time. Method 1000 may additionally, or alternatively, include at 1082 adjusting, at a blower fan (e.g., blower fan 48) of the dryer appliance, a flowrate of process air (e.g., moisture laden air MLA) through the conditioning system based on the rate of change of moisture extraction rate corresponding to the drying cycle end time. The condensation rate may be adjusted in accordance with the determined rate of change of moisture extraction rate necessary to achieve the desired drying cycle end time.

Method 1000 may further include at 1090 stopping the drying cycle at the drying cycle end time. Method 1000 at 1090 may contrast with operating de-wrinkle or intermittent cycles prior to user retrieving the articles. Method 1090 may particularly include ending heating or thermal energy transfer to the process air. Method 1090 may additionally, or alternatively, include ending flow of process air through the conditioning system. User may accordingly receive articles warm and dry at the desired drying cycle end time. Embodiments provided may additionally allow for warm and dry laundry articles LA to be dried at the desired drying cycle end time while mitigating or eliminating risks associated with excessive temperature or thermal energy to the process air or to the laundry articles LA, including, but not limited to, damage to the laundry articles LA, fire risks, excessive energy consumption, or damage to components of the drying appliance associated with usage, wear, or deterioration.

Further aspects of the subject matter are provided by one or more of the following clauses:

1. A dryer appliance comprising a cabinet; a drum rotatably mounted within the cabinet, the drum defining a chamber for receipt of a load of articles for drying, the drum defining a drum outlet and a drum inlet to the chamber; a conditioning system configured to heat and remove moisture from process air flowing therethrough; a duct system for providing fluid communication between the drum outlet and the conditioning system and between the conditioning system and the drum inlet, the duct system, the conditioning system, and the drum defining a process air flowpath; a blower fan operable to move process air along the process air flowpath; and a controller, wherein during a drying cycle. The controller is configured to receive an input indicative of a drying cycle end time; determine, during the drying cycle, a moisture extraction rate based at least in part on the received input indicative of drying cycle end time, the moisture extraction rate indicative of a rate at which moisture is removed from articles within the chamber; determine a rate of change of moisture extraction rate; and adjust a condensation rate based at least on the rate of change of moisture extraction rate and the received input indicative of the drying cycle end time.

2. The dryer appliance of any one or more clauses herein, wherein the controller configured to determine the rate of change of moisture extraction rate comprises determining the rate of change of moisture extraction rate to correspond to the drying cycle end time.

3. The dryer appliance of any one or more clauses herein, the controller configured to receive a dry load weight; receive a wetted load weight; and determine an amount of fluid to be removed from the load of articles based at least on a difference between the dry load weight and the wetted load weight.

4. The dryer appliance of any one or more clauses herein, the controller configured to determine an initial condensation rate of the drying cycle based on the received input indicative of the drying cycle end time and the amount of fluid to be removed from the load of articles.

5. The dryer appliance of any one or more clauses herein, the controller configured to determine a load type based at least on the difference between the dry load weight and the wetted load weight compared to the dry load weight, and adjust a mass flow rate of process air based on the determined load type and the amount of fluid to be removed from the load of articles.

6. The dryer appliance of any one or more clauses herein, the controller configured to monitor an input temperature of air into the chamber; and monitor an output temperature of air from the chamber, wherein the moisture extraction rate is determined based on a difference between the input temperature and the output temperature.

7. The dryer appliance of any one or more clauses herein, the controller configured to monitor an input moisture of air into the chamber; and monitor an output moisture of air into the chamber, wherein the moisture extraction rate is determined based on a difference between the input moisture and the output moisture.

8. The dryer appliance of any one or more clauses herein, wherein the conditioning system has a heater element positioned to provide heat to process air flowing along the process air flowpath.

9. The dryer appliance of any one or more clauses herein, wherein the heater element comprises a variable speed compressor.

10. The dryer appliance of any one or more clauses herein, wherein causing adjustment of the condensation rate comprises one or more of adjusting a heat from a condenser at the conditioning system.

11. The dryer appliance of any one or more clauses herein, wherein adjustment of the condensation rate comprises the controller configured to cause the blower fan to adjust the flowrate of process air flowing along the process air flowpath based at least on the determined rate of change of moisture extraction rate.

12. A controller for a dryer appliance, the controller configured to store instructions that, when executed, causes the dryer appliance to perform operations, the operations comprising receiving an input indicative of a drying cycle end time; determining a moisture extraction rate based at least in part on the received input indicative of drying cycle end time, the moisture extraction rate indicative of a rate at which moisture is removed from articles within a chamber of the dryer appliance; determining a rate of change of moisture extraction rate corresponding to the drying cycle end time; and adjusting a condensation rate based at least on the rate of change of moisture extraction rate and the received input indicative of the drying cycle end time.

13. The controller of any one or more clauses herein, the operations comprising receiving a dry load weight; receiving a wetted load weight; and determining an amount of fluid to be removed from a load of articles based at least on a difference between the dry load weight and the wetted load weight.

14. The controller of any one or more clauses herein, the controller communicatively coupled to the dryer appliance and a washer appliance, the controller configured to receive the dry load weight and receive the wetted load weight is from the washer appliance.

15. The controller of any one or more clauses herein, the operations comprising determining an initial condensation rate of the drying cycle based on the input indicative of the drying cycle end time and the amount of fluid to be removed from the load of articles.

16. The controller of any one or more clauses herein, the operations comprising determining a load type based at least on the difference between the dry load weight and the wetted load weight compared to the dry load weight, and adjusting a mass flow rate of process air based on the determined load type and the amount of fluid to be removed from the load of articles.

17. The controller of any one or more clauses herein, the operations comprising monitoring an input temperature of air into the chamber; and monitoring an output temperature of air from the chamber, wherein the moisture extraction rate is determined based on a difference between the input temperature and the output temperature.

18. The controller of any one or more clauses herein, the operations comprising monitoring an input moisture of air into the chamber; and monitoring an output moisture of air into the chamber, wherein the moisture extraction rate is determined based on a difference between the input moisture and the output moisture.

19. The controller of any one or more clauses herein, the operations comprising adjusting, via adjusting a compressor speed at a conditioning system, a moisture extraction rate corresponding to the drying cycle end time; and adjusting, at a blower fan at the conditioning system of the dryer appliance, a flowrate of process air through the conditioning system based on the rate of change of moisture extraction rate corresponding to the drying cycle end time.

20. The controller of any one or more clauses herein, the operations comprising stopping the drying cycle at the drying cycle end time.

21. A combination washer-dryer appliance comprising the controller of any one or more clauses herein.

22. A system comprising a washer appliance and a dryer appliance communicatively coupled to the washer appliance, the system comprising the controller of any one or more clauses herein.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A dryer appliance, comprising:

a cabinet;

a drum rotatably mounted within the cabinet, the drum defining a chamber for receipt of a load of articles for drying, the drum defining a drum outlet and a drum inlet to the chamber;

a conditioning system configured to heat and remove moisture from process air flowing therethrough;

a duct system for providing fluid communication between the drum outlet and the conditioning system and between the conditioning system and the drum inlet, the duct system, the conditioning system, and the drum defining a process air flowpath;

a blower fan operable to move process air along the process air flowpath; and a controller, wherein during a drying cycle, the controller is configured to:

receive an input indicative of a drying cycle end time;

determine, during the drying cycle, a moisture extraction rate based at least in part on the received input indicative of drying cycle end time, the moisture extraction rate indicative of a rate at which moisture is removed from articles within the chamber;

determine a rate of change of moisture extraction rate; and adjust a condensation rate based at least on the rate of change of moisture extraction rate and the received input indicative of the drying cycle end time.

2. The dryer appliance of claim 1, wherein the controller configured to determine the rate of change of moisture extraction rate comprises determining the rate of change of moisture extraction rate to correspond to the drying cycle end time.

3. The dryer appliance of claim 1, the controller configured to:

receive a dry load weight;

receive a wetted load weight; and determine an amount of fluid to be removed from the load of articles based at least on a difference between the dry load weight and the wetted load weight.

4. The dryer appliance of claim 3, the controller configured to:

determine an initial condensation rate of the drying cycle based on the received input indicative of the drying cycle end time and the amount of fluid to be removed from the load of articles.

5. The dryer appliance of claim 3, the controller configured to:

determine a load type based at least on the difference between the dry load weight and the wetted load weight compared to the dry load weight, and adjust a mass flow rate of process air based on the determined load type and the amount of fluid to be removed from the load of articles.

6. The dryer appliance of claim 1, the controller configured to:

monitor an input temperature of air into the chamber; and monitor an output temperature of air from the chamber, wherein the moisture extraction rate is determined based on a difference between the input temperature and the output temperature.

7. The dryer appliance of claim 1, the controller configured to:

monitor an input moisture of air into the chamber; and monitor an output moisture of air into the chamber, wherein the moisture extraction rate is determined based on a difference between the input moisture and the output moisture.

8. The dryer appliance of claim 1, wherein the conditioning system has a heater element positioned to provide heat to process air flowing along the process air flowpath.

9. The dryer appliance of claim 8, wherein the heater element comprises a variable speed compressor.

10. The dryer appliance of claim 8, wherein causing adjustment of the condensation rate comprises one or more of adjusting a heat from a condenser at the conditioning system.

11. The dryer appliance of claim 10, wherein adjustment of the condensation rate comprises the controller configured to:

cause the blower fan to adjust a flowrate of process air flowing along the process air flowpath based at least on the determined rate of change of moisture extraction rate.

12. A controller for a dryer appliance, the controller configured to store instructions that, when executed, causes the dryer appliance to perform operations, the operations comprising:

receiving an input indicative of a drying cycle end time;

determining a moisture extraction rate based at least in part on the received input indicative of drying cycle end time, the moisture extraction rate indicative of a rate at which moisture is removed from articles within a chamber of the dryer appliance;

determining a rate of change of moisture extraction rate corresponding to the drying cycle end time; and adjusting a condensation rate based at least on the rate of change of moisture extraction rate and the received input indicative of the drying cycle end time.

13. The controller of claim 12, the operations comprising:

receiving a dry load weight;

receiving a wetted load weight; and determining an amount of fluid to be removed from a load of articles based at least on a difference between the dry load weight and the wetted load weight.

14. The controller of claim 13, the controller communicatively coupled to the dryer appliance and a washer appliance, the controller configured to receive the dry load weight and receive the wetted load weight is from the washer appliance.

15. The controller of claim 13, the operations comprising:

determining an initial condensation rate of a drying cycle based on the input indicative of the drying cycle end time and the amount of fluid to be removed from the load of articles.

16. The controller of claim 13, the operations comprising:

determining a load type based at least on the difference between the dry load weight and the wetted load weight compared to the dry load weight, and adjusting a mass flow rate of process air based on the determined load type and the amount of fluid to be removed from the load of articles.

17. The controller of claim 12, the operations comprising:

monitoring an input temperature of air into the chamber; and monitoring an output temperature of air from the chamber, wherein the moisture extraction rate is determined based on a difference between the input temperature and the output temperature.

18. The controller of claim 12, the operations comprising:

monitoring an input moisture of air into the chamber; and monitoring an output moisture of air into the chamber, wherein the moisture extraction rate is determined based on a difference between the input moisture and the output moisture.

19. The controller of claim 12, the operations comprising:

adjusting, via adjusting a compressor speed at a conditioning system, a moisture extraction rate corresponding to the drying cycle end time; and adjusting, at a blower fan at the conditioning system of the dryer appliance, a flowrate of process air through the conditioning system based on the rate of change of moisture extraction rate corresponding to the drying cycle end time.

20. The controller of claim 12, the operations comprising:

stopping a drying cycle at the drying cycle end time.

* * * * *